United States Patent [19]

Jensen

[11] Patent Number: 4,561,339

[45] Date of Patent: Dec. 31, 1985

[54] MUSIC STAND FOR GUITAR PLAYER

[76] Inventor: Gary L. Jensen, E. 2410 - 29th, Spokane, Wash. 99203

[21] Appl. No.: 586,282

[22] Filed: Mar. 5, 1984

[51] Int. Cl.[4] ..... G10D 3/00

[52] U.S. Cl. ..... 84/453; 84/327; 84/328; 248/441.1

[58] Field of Search ..... 84/327-329, 84/453; 248/441.1, 443

[56] References Cited

U.S. PATENT DOCUMENTS 1,045,583 11/1912 Mills ..... 84/327 X
1,853,913 4/1932 Mariner, Jr. .
2,547,924 4/1951 Citro .

FOREIGN PATENT DOCUMENTS 2753518 7/1979 Fed. Rep. of Germany ..... 84/327

*Primary Examiner*—Lawrence R. Franklin
*Attorney, Agent, or Firm*—Keith S. Bergman

[57] ABSTRACT

An upright music stand that adjustably supports a footrest in its lower portion to aid a guitar player using the stand in maintaining classical guitar playing posture. The upper portion of the stand carries a guitar neck rest which cooperates with a body support carried by the footrest to support a guitar in vertical position when not in use. The music stand may be of the foldably collapsible type.

5 Claims, 5 Drawing Figures

MUSIC STAND FOR GUITAR PLAYER

BACKGROUND OF INVENTION

1. Field of Invention

My invention relates generally to music stands and more particularly to such stands for guitar players that provide a footrest and instrument support structure.

2. Description of Prior Art

The normal playing of many musical instruments, and particularly guitars, requires the continuous use of both hands of the musician. By reason of this the hands of a muscian playing such instruments are not generally available for support and manipulation of written music and responsively many and various music stands have been devised to hold music while such a musician is playing.

Various musical instruments such as the guitar, require special posturing of a musician for proper playing, but unfortunately known music stands generally have not taken this requirement into consideration, at least in the case of guitar players. In the playing of the classic Spanish guitar and some other similar instruments, proper posturing requires the musician to be seated with one knee, generally that of the side of non-principal activity of the musician, to be somewhat raised, usually by supporting the foot of that leg above the general underlying supporting surface. The supported foot should also extend in front of the player's body without any substantial lateral displacement. This posturing is especially desirable, if not necessary, in the case of students and young or inexperienced guitar players. Such posturing generally has been accomplished by the use of a small, appropriately configured foot stool. My instant invention provides a music stand that fills this need by providing an interconnected footrest and also an associated support structure for a guitar when not in use.

Heretofore music stands, footrests and instrument supports have all become known per se in various individual forms and sub-combinations. My invention resides not in any one of these elements individually but rather in the combination of all three elements as particularly adapted for use by guitar players. My invention provides auxiliary structures for use with existing music stands of present day commerce and may be used with most of the various types of both non-folding and collapsibly folding varieties of stands. My footrest is supported by the pedestal of a music stand in a movable fashion that allows adjustable vertical positioning. Its own internal structure allows adjustment of its angle to horizontal. Both features readily distinguish it from traditional foot supports heretofore used by guitar players that provide no necessary association with a music stand nor the flexible height and angle adjustments of my invention.

Various supports for musical instruments have become known and some have heretofore been associated with a music stand. In general this latter type of instrument support has provided a one point type support of a hook-like nature. Such support undoubtedly is dictated in its essence by the nature of music stands, because generally there is no structure in the lower part of the stand to support the base of an instrument so the instrument must be either suspended or partially supported on a surface underlying the stand. This type of support is not convenient for use with a guitar and well may damage the instrument. My invention provides three point support with an upper yoke to hold the neck and paired cooperating body rests carried by my footrest to support the base of the guitar in a two point fashion that tends to do no damage to the instrument and well maintains support against accidental impact or motion of guitar or stand. The guitar rest associated with the footrest also serves a secondary purpose of aiding in maintaining the foot of a user on the footrest should it accidentally move laterally from normal support thereon.

My invention is distinguished from the prior art not by reason of any one of its features individually but rather by reason of the particular combination of all of those features which necessarily perform the functions indicated to provide combinational novelty.

SUMMARY OF INVENTION

My invention generally provides an upright music stand adjustably supporting a footrest and guitar support structure.

The music stand provides a base that supports an adjustable upright pedestal that in turn supports a music support in its uppermost extension.

My footrest provides a collar, adjustably positionable on the lower part of the music stand pedestal, that pivotally supports an outwardly extending foot pedal. A secondary support depends from the foot pedal to allow adjustable vertical positioning of the outermost end of the foot pedal to adjust its horizontal angle.

My guitar support provides an upper yoke-like neck support carried on the upper portion of the music stand pedestal for adjustable vertical positioning. A lower guitar base support, carried by the medial part of the footrest in a position below the neck support cooperates therewith to support a guitar in a slightly angled upright fashion therebetween.

In providing such a device it is:

A principal object of my invention to provide a music stand with a footrest for a guitar player and a support to maintain a guitar in vertical position during periods of non-use.

A further object of my invention to provide such a guitar support that has an upper neck support vertically adjustable relative to a lower body support to accommodate various types and sizes of guitars or other similar instruments and maintain them in three point support in a secure fashion that does not damage them.

A further object of my invention to provide such a footrest that is adjustably positionable both vertically and for pedal slope, one that is stable, and that is in proper spatial position relative the music stand for normal and proper use.

A still further object of my invention to provide such a device that may use music stands of present day commerce and combine them with ancillary structures to form my invention.

A still further object of my invention to provide such a music stand that is of new and novel design, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawing, as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 2:
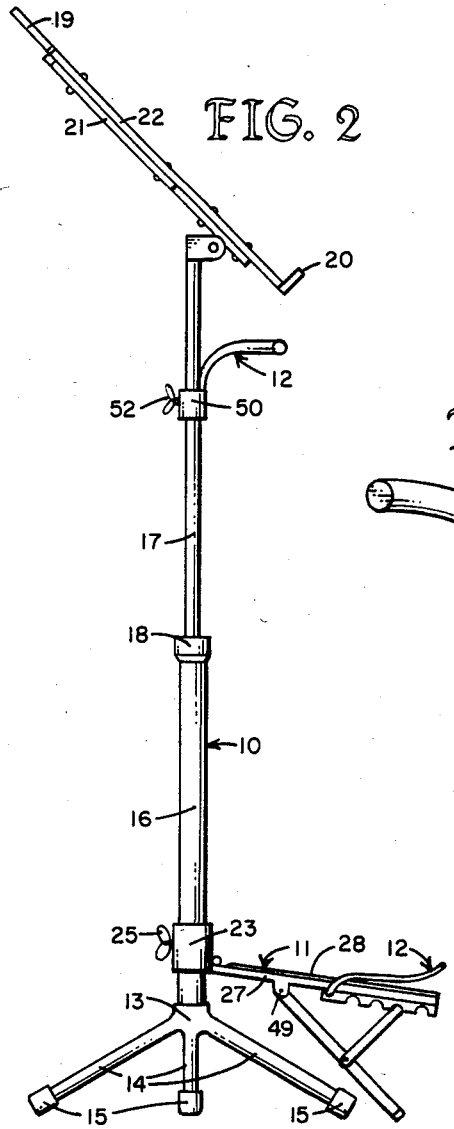
FIG. 2 is an orthographic, side view of the music stand illustrated in FIG. 1 showing its various parts from this aspect.

My invention generally provides music stand 10 supporting adjustably positionable footrest structure 11 in a lower position thereon and guitar support structure 12 with adjustably positionable neck support supported on the upper portion of the music stand pedestal and lower body support supported on the footrest structure.

Music stand 10 is of a typical variety of present day commerce providing a foot-like base with body 13 interconnecting three tripodal type legs 14 with cup-like tips 15 fitted in their end parts and defining a pedestal channel (not shown) in its medial part. In the instance illustrated these parts of the base are rigidly interconnected, but foldable bases of various types are known that are quite effective in use with my invention.

The base supports in its pedestal channel a compound pedestal formed by lower pipe-like pedestal base 16 slidably supporting smaller upper pedestal extension 17 in a medially defined channel with a Jacobs type chuck 18 communicating therebetween to releasably position the two elements in adjustable vertical relationship with each other. In the instance illustrated each of the pedestal elements are of a circularly cylindrical configuration but this cross-sectional shape is not necessary to my invention and various other sectional configurations used in present day music stand pedestals are operative. The circular configuration, however, does have benefits in allowing my footstand and guitar rest structures to be positioned in various angular postions relative to the music stand if desired.

The uppermost portion of upper pedestal extension 17 provides structurally communicating hinge-type bracket extending laterally therefrom to pivotally mount a music support. This bracket communicates with music support bracket carried by the body of the music support to interconnect those structures. Preferably the nature of the pivotal interconnection is such as to provide a frictional type joinder that allows the angular relation of the music stand relative to the pedestal to be changed by appropriate manual manipulation but yet provide sufficient friction to maintain the positioning once established, at least during ordinary use conditions.

The music support proper comprises medial upstanding body 19 structurally joined with lower horizontal ledge 20. Similar lateral wing supports are provided on each side of the body by similar horizontal support 21 and vertical supports 22 interconnected in their upper lateral portions, in this case by rivets. Each wing support is supported in the space between body and ledge, with the inner end portion of the upper support element fastened in the medial portion of the body and the lower end portion of the vertical support fastened in a lateral part of the ledge, all to provide the structure illustrated especially in FIG. 1. Oftentimes the joinder of these elements in commercial music stands may be pivotal and ledge element 20 may be a compound structure so that the music support may be folded. Either type of structure, whether the support be rigid or foldable, will operate equally well with my invention.

In general this type of music stand described is well known and readily available in present day channels of commerce. The stand may take different forms depending upon particular accidental configurational variance but in essence almost all of the present day music stands present the essential features described and any that do are operative with and as a component part of my invention. These stands must be rigid and normally will be formed of metallic parts. I prefer metal stands because not only of their greater rigidity but also their durability under adverse conditions.

Figure 5:
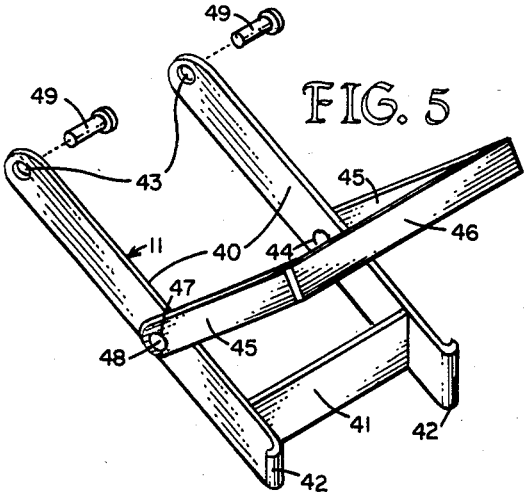
FIG. 5 is a similarly enlarged isometric view of the depending pedal support associated with the foot rest structure.
Figure 4:
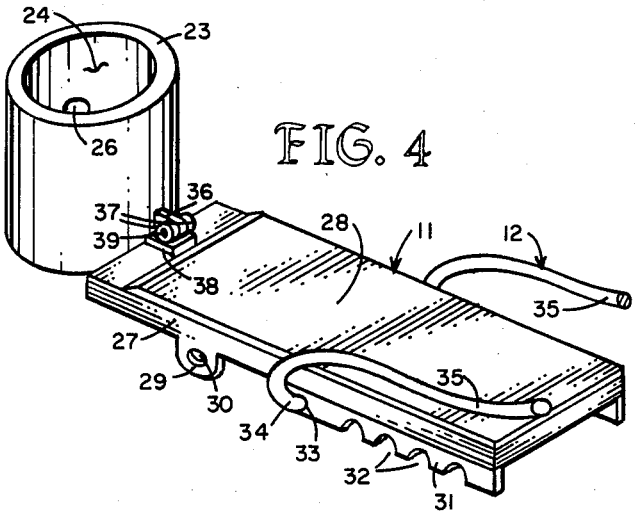
FIG. 4 is a somewhat enlarged isometric view of the fastening collar and pedal of my footrest structure.

Footrest 11 is illustrated in detail in FIGS. 4 and 5 where it is seen to include a pedal structure pivotally interconnected with a pedestal support and a foot for floor support. The pedestal support provides annular cylindrical body 23 defining pedestal channel 24 configured to slidably fit about the periphery of pedestal base 16. This pedestal support is positionally maintained on the pedestal base by thumb screw 25 threadedly engaged in fastener hole 26 defined through the support body.

Foot pedal body 27 is a generally rectilinear planar element configured and dimensioned to support a human foot and formed of material providing appropriate rigidity so to do. It is preferably provided with relatively thin, peripherally coincident pedal cover 28 mechanically attached, in the instance illustrated by adhesion. This pedal cover is formed of resiliently deformable material such as rubber or softer plastic to provide a more comfortable foot support. The cover should have an upper surface that generates some substantial friction with the foot (normally shod) of a user either by its inherent nature or some impressed surface configuration to aid in maintaining a user's foot on the pedal once it is placed.

Similar opposed foot fastening ears 29, each defining similar cooperating holes 30, depend from each side of the pedal in its medially inner portion to allow fastening of foot structure. Similar opposed cooperating foot adjustment brackets 31 depend from each side of the outer portion of the pedal body. Each foot adjustment bracket defines plural cooperating fastening notches 32 arrayed in spaced relationship and extending rearwardly from the forward portion of the bracket.

The pedal mechanism is pivotally attached to the pedal support by hinge structure shown in FIG. 4. Hinge leaf 36, mechanically attached to the peripheral surface of pedestal support 23 extends outwardly therefrom to a position between hasps 37 carried by hinge bracket 38 which in turn is mechanically carried by the upper surface of pedal body 27. Hinge pin 39 extends through cooperating holes defined in the hinge leaf and hinge hasps to pivotally join these elements to form the complete hinge structure.

The pedal foot structure is illustrated particularly in FIG. 5 where it is seen to comprise two elongate parallel foot elements 40 spacedly maintained by lower cross support 41 structurally communicating therebetween. Each of the foot elements defines a laterally outwardly turned foot portion 42 in its lowermost part to aid support on an underlying surface, pedal fastening hole 43 in its upper part, and adjustment bracket hole 44 in its medial part. The adjustment bracket is a "U" shaped structure formed of similar opposed lateral legs 45 structurally joined by cross piece 46 in their uppermost extensions. The bracket legs in their lowermost portion define fastening holes 47 with headed fastening pins 48 extending through those holes and through the adjacent bracket fastening holes defined in the foot structure legs to pivotally join these elements. The adjustment bracket is appropriately dimensioned so that its legs fit immediately adjacent the legs of the foot structure so that the two structures may be pivotally interconnected and so that the upper portion of the foot structure legs may fit immediately adjacent foot fastening ears 29 of the pedal structure where they are pivotally interconnected by fastening pins 49 extending between each adjacent cooperating pair of fastening holes.

Figure 1:
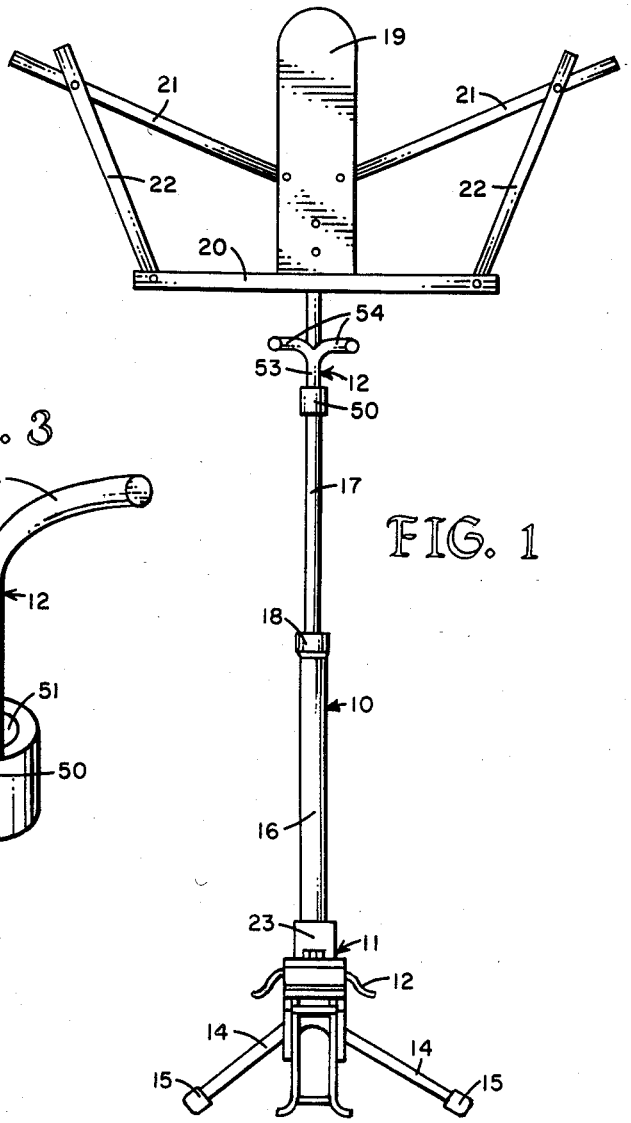
FIG. 1 is an orthographic, front view of my music stand showing its various parts, their configuration and relationship.

The adjustment bracket then when assembled with the pedal structure, as illustrated particularly in FIGS. 1 and 2, extends upwardly therefrom into engagement with foot adjustment bracket 31 to allow vertical adjustment of the pedal structure relative to an underlying surface supporting both the music stand and pedal foot. By cooperative adjustment of the pedal foot structure and the pedal collar upon the music stand pedestal, both the elevation of the pedal and its angular relationship to either the music stand or an underlying supporting surface may be appropriately adjusted, within limits.

Figure 3:
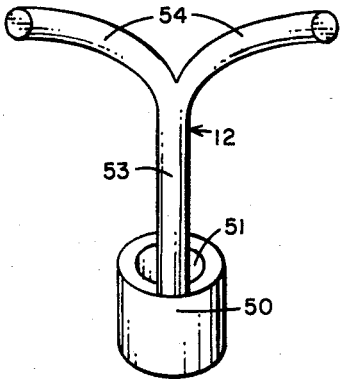
FIG. 3 is a somewhat enlarged isometric view of the guitar neck support of my invention.

The upper portion of music stand 12 carries the neck support illustrated generally in FIG. 2 and particularly in FIG. 3. This neck support provides cylindrical collar 50 definiing internal pedestal extension chamber 51 extending therethrough and having a configuration such as to provide a slideable fit of the support body on the pedestal extension. Thumb screw 52 extends through a threaded hole (not shown) defined through support body 50 to provide means of adjustably positioning the support on the pedestal extension. The neck support proper provides medial body 53 extending upwardly from mechanical attachment to support body 50 and carrying "Y" shaped legs 54 extending upwardly and outwardly in a curvilinear fashion from the support body to define the illustrated yoke structure which will positionally maintain the neck of a guitar placed therein.

The inner part of the adjustment bracket of the foot rest structure carries the guitar base support providing medial body 34 extending through opposed cooperating holes 33 defined in the inner part of the adjustment brackets with curvilinear support arms 35 extending outwardly and upwardly therefrom. The mechanical interconnection of the lower guitar body support with the pedal structure should be such as to prevent rotary motion between the two elements or the support will not serve its purpose. The exact shape of support arms 35 is not critical to my invention but in general it should be such as to reasonably well support the bottom of a guitar body and yet cause no damage to it through the range of positions of the foot rest structure. If desired auxiliary covering (not shown) might be added to the support arms to further protect a guitar body and provide greater frictional engagement between it and the support arms.

Preferably all of the parts of the guitar neck support are formed of metal and the mechanical joinder of parts is accomplished by welding. Again, some resiliently deformable material that has a surface of high frictional characteristics may be placed on the "Y" shaped support arms to aid in preventing damage to a guitar and aid its positional maintenance.

From the foregoing description of the structure of my invention its use may be readily understood.

Firstly, a music stand as specified is created or procured and outfitted with my foot rest and guitar support structures as specified and illustrated particularly in FIGS. 1 and 2. The music stand will be used by a guitar player in a seated position so the height of the music stand pedestal is adjusted for such use. The guitar player then, while seated in a normal playing position on the forward side of the stand (the right side of the device illustrated in FIG. 2), adjusts the neck support and foot pedal if necessary so that they extend toward him. He then determines empirically by trial and error the appropriate height of the pedal for most comfortable use and adjusts the pedal to this height by loosening thumb screw 25 in the pedestal collar, manually positioning the collar to the appropriate height by sliding it on the pedestal base and thereafter tightens the thumb screw to releasably maintain the collar in this position. The angle of the pedal relative to the horizontal is then adjusted to an appropriate and comfortable position by moving crosspiece 46 of the pedal adjustment bracket into the appropriate cooperating pair of adjustment notches 32 devined in the foot adjustment brackets. The structure is then ready to be used by the player in supporting one foot, normally that of his non-principal side of activity, in gaining proper foot positioning to allow him to assume classic guitar playing posture.

At times when the stand is desired to be used for guitar support, the neck bracket is appropriately positioned on the pedestal extension by loosening its adjustment screw 52, manually moving the support collar to the desired position and thereafter tightening the fastening screw to maintain that position. The required position to support a guitar neck is variable over a fairly wide range and the exact position determined is largely a matter of choice, but that position should be so determined as to provide a reasonably maintainable support that does not damage the guitar. After the neck support is so adjusted a guitar may be placed with the lower portion of its body resting on the two body supports carried by and extending above the foot pedal and its neck resting between the legs of the "Y" shaped yoke of the neck support. The guitar will, after placement, be positionally maintained against fairly substantial external forces, though obviously not against all possible forces.

It is to be noted that the curvilinear shape of the base support carried by the pedal structure, because of its upwardly and outwardly curved configuration, provides support for a guitar body over the full range of adjustable positions of the foot pedal.

It is further to be noted that, if desired, an additional support element (not shown) especially of an elastic, resilient nature might be established between the two "Y" shaped legs of the neck support and over the neck of a supported guitar to more firmly positionally maintain that guitar neck. This normally is not desired, however, as it may damage the guitar strings. An ordinary rubber band of appropriate size well fulfills this function if desired.

It is to be noted that various of the commercial music stands of present day commerce may be used with my invention. Both the foot rest and guitar support structure may be readily adapted for use with those guitar stands having pedestals of varying shape merely by appropriately shaping the channel in both the pedestal support and guitar neck support.

It is further to be noted that in general, though a fully foldable music stand is not shown in the illustrations, my invention may be quite readily used with most of such music stands of present day commerce without any modification in the stand itself.

It is further to be noted that the footrest structure might be supported only on a music stand pedestal in a cantilever fashion without any direct support on an underlying supporting surface. Such a footrest is not practical with ordinary music stands however, as too great a tipping moment is created to make the structure unstable in general use.

The foregoing description of my invention is necessarily of a detailed nature so that a specific embodiment of it may be set forth, as required, but it is to be understood that various modifications of detail, rearrangement and multiplication of parts might be resorted to without departing from its spirit, essence or scope.

Having thusly described my invention, what I desire to protect by Letters Patent, and

What I claim is:

1. In a music stand for guitar players having a base supporting an upright pedestal in turn supporting a music support in its upper part, the invention comprising, in combination:

a foot rest, adjustably supported by the lower portion of the music stand pedestal, having a pedestal collar carried by the pedestal and hingeably communicating with a pedal, said pedestal collar adapted to support the foot of user and having a depending foot structure to support the outer portion of the pedal at an adjustable distance above an underlying supporting surface.

2. The invention of claim 1 further comprising:

a guitar stand having paired opposed guitar body supports extending a spaced distance above the foot pedal and a neck support, carried by the upper portion of the pedestal, with means to support the neck of a guitar.

3. The invention of claim 1 wherein the foot rest is further characterized by:

the pedestal collar being adjustably positionable on a supporting pedestal and the foot structure supporting the pedal comprising two spaced elongate feet extending downwardly to contact an underlying supporting surface from pivotal communication with the pedal near its interconnection with the music stand pedestal;

a "U" shaped adjustment bracket having two legs pivotally communicating with the medial portion of the spaced elongate feet extending upwardly therefrom to be joined by a crosspiece and adjustment brackets carried by the outer portion of the pedal structure spaced sets of having paired cooperating notches to receive the crosspiece of the adjustment bracket.

4. A music stand for guitar players having means to support a player's foot at a spaced distance above an underlying supporting surface and means of supporting a guitar when not in use, comprising, in combination:

a base supporting an upright pedestal in turn supporting a music support thereabove;

a footrest structure comprising a pedestal collar carried by the lower portion of the pedestal for sliding motion thereon and having means for adjustable positioning on said pedestal, said pedestal collar pivotally communicating with an elongate pedal extending away therefrom and adapted to support a user's foot, said pedestal having foot structure with means for adjustably supporting the outer portion of the pedal at various distances above an underlying supporting surface; and guitar support structure comprising a guitar body rest carried by the foot rest structure and a guitar neck support carried by the upper portion of the music stand pedestal, said neck support having means for adjustable vertical positioning thereon.

5. The invention of claim 4 further characterized by:

the means for adjustably supporting the outer portion of the pedal above an underlying surface comprising two spaced cooperating elongate support feet depending from pivotal communication with the inner portion of the pedal with a "U" shaped adjustement bracket having spaced legs pivotally interconnected with the medial portion of the support legs and extending upwardly therefrom to interconnection with a crosspiece engageable in one set of a plurality of sets of cooperating spaced adjustment notches defined in paired spaced adjustment brackets depending from each lateral portion of the undersurface of the outer part of the pedal.

* * * * *